US010208982B2

(12) United States Patent
Bannish et al.

(10) Patent No.: US 10,208,982 B2
(45) Date of Patent: Feb. 19, 2019

(54) AIRFOIL BLADE AND METHOD OF ASSEMBLY

(71) Applicants: John Bannish, Granville, MA (US); Jim Monahan, West Springfield, MA (US)

(72) Inventors: John Bannish, Granville, MA (US); Jim Monahan, West Springfield, MA (US)

(73) Assignee: MESTEK, INC., Westfield, MA (US)

( * ) Notice: Subject to any disclaimer, the term of this patent is extended or adjusted under 35 U.S.C. 154(b) by 139 days.

(21) Appl. No.: 15/000,678

(22) Filed: Jan. 19, 2016

(65) Prior Publication Data

US 2016/0216000 A1 Jul. 28, 2016

Related U.S. Application Data

(60) Provisional application No. 62/106,868, filed on Jan. 23, 2015.

(51) Int. Cl.

| | |
|---|---|
| ***F24F 7/00*** | (2006.01) |
| ***F24F 13/14*** | (2006.01) |
| ***F24F 13/15*** | (2006.01) |

(52) U.S. Cl.
CPC ..... *F24F 13/1413* (2013.01); *F24F 13/15* (2013.01)

(58) Field of Classification Search
CPC ..... F24F 13/15; F24F 13/10; F24F 13/1413; F24F 13/14
USPC ..... 454/336, 335; 160/236
See application file for complete search history.

(56) References Cited

U.S. PATENT DOCUMENTS

| | | | | |
|---|---|---|---|---|
| 2,390,227 A | | 12/1945 | Smith | |
| 2,643,627 A | * | 6/1953 | Wobbe | B21D 51/32 220/614 |
| 2,718,885 A | * | 9/1955 | Ericson | F23L 13/00 126/285 R |
| 3,547,152 A | | 12/1970 | Hess | |
| 4,382,460 A | * | 5/1983 | Ben-Tal | E06B 7/084 160/236 |
| 4,610,197 A | | 9/1986 | Van Becelaere | |

* cited by examiner

*Primary Examiner* — Vivek Shirsat
(74) *Attorney, Agent, or Firm* — Grogan, Tuccillo & Vanderleeden, LLP

(57) ABSTRACT

An airfoil blade assembly includes a first shell member having a body having a first lock seam formed at one end thereof and a free distal end opposite the first lock seam, and a second shell member having a body having and a second lock seam formed at one end thereof and an a free distal end opposite the second lock seam. The second shell member is inverted with respect to the first shell member. The free distal end of the first shell member is captured within the second lock seam of the second shell member and the free distal end of the second shell member is captured within the first lock seam of the first shell member to lock the blades to one another.

17 Claims, 5 Drawing Sheets

AIRFOIL BLADE AND METHOD OF ASSEMBLY

CROSS REFERENCE TO RELATED APPLICATIONS

The present application is a U.S. utility patent application claiming priority to the U.S. provisional application Ser. No. 62/106,868, filed on Jan. 23, 2015.

FIELD OF THE INVENTION

The present invention relates to dampers and, more particularly, to an airfoil blade for a damper and a method of assembling an airfoil blade.

BACKGROUND OF THE INVENTION

Dampers have long been used in a variety of fluid handling applications to control the flow of various types of fluids. Typical uses of industrial dampers include the handling of process control fluids, the handling of fluids in power plants, and the handling of high speed fan discharge streams. Industrial dampers are usually subjected to relatively high pressures and must have considerable strength in order to be capable of withstanding the forces that are applied to them.

The damper construction normally includes a rigid frame which defines a flow passage controlled by a plurality of damper blades that each pivot between open and closed positions about a respective axle. The blades are often interconnected by a linkage which moves all of them in unison to control the fluid flow rate in accordance with the damper blade position. Although flat damper blades are often used, it has long been recognized that airfoil shapes can be used to enhance the fluid flow. Airfoil blades are thickest in the center at the pivot axis and taper toward each edge to present an aerodynamically efficient shape which minimizes turbulence and other undesirable effects such as noise generation and stresses on the flow passage and other components of the fluid handling system.

In the past, damper blades have been formed by bending multiple sheets of steel and joining them together to form an airfoil shape. Typically, in a separate step, a bead of silicone or other sealant may be manually deposited at the respective ends of each blade to provide for an air tight seal between the damper blades when in a closed position. In a further separate step, a bracket is mounted to each end of the blade, which is necessary to locate and accommodate an axle on which each blade pivots. As will be readily appreciated, however, existing airfoil blades are very time consuming and tedious to manufacture, requiring numerous and separate manual steps. In addition, existing blades often require additional strengthening ribs to bolster the blade under high speed flow, which may further increase the cost and labor involved.

Accordingly, it is desirable to provide an airfoil blade assembly that is easier, more cost effective, and less labor-intensive to produce than existing blades.

SUMMARY OF THE INVENTION

According to the present invention, an airfoil blade assembly includes a first shell member having a body having a first lock seam formed at one end thereof and a free distal end opposite the first lock seam, and a second shell member having a body having and a second lock seam formed at one end thereof and an a free distal end opposite the second lock seam. The second shell member is inverted with respect to the first shell member. The free distal end of the first shell member is captured within the second lock seam of the second shell member and the free distal end of the second shell member is captured within the first lock seam of the first shell member to lock the blades to one another.

According to another embodiment of the present invention a method of assembling an airfoil blade includes roll forming first and second shell members of the airfoil blade on a roll forming machine and depositing a sealant bead in an end seam of each of the shell members on the roll forming machine in an inline process. The method also includes joining two shell members to one another and crimping respective ends of each shell member to form a lock seam which captures a free edge of the opposed shell member therein to lock the shell members to one another.

According to yet another embodiment of the present invention, a damper assembly is provided. The damper assembly includes a frame, an axle rotatably mounted to the frame, and an airfoil blade assembly operatively mounted to the axle. The airfoil blade assembly includes an upper shell member and a lower shell member, wherein said lower shell member is invertedly disposed and connected to said upper shell member.

DETAILED DESCRIPTION OF PREFERRED EMBODIMENTS

Figure 2:
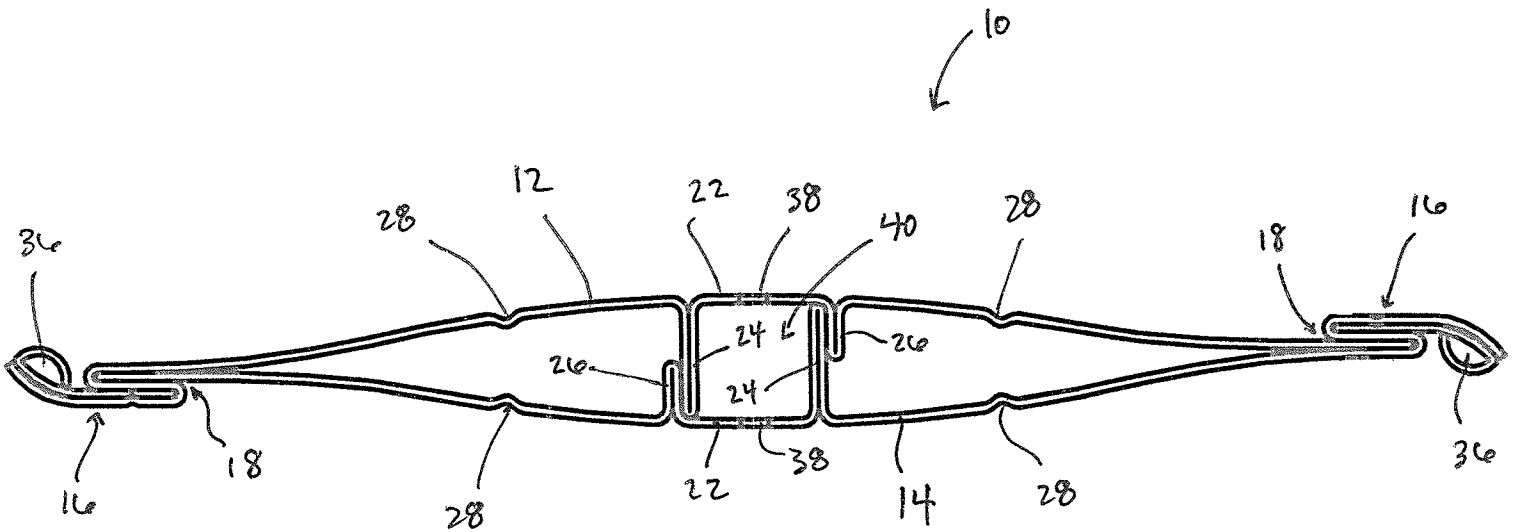
FIG. 2 is a cross-sectional view of an airfoil blade constructed according to an embodiment of the present invention.

With reference to the drawings, reference numeral 10 generally designates an airfoil blade constructed in accordance with the present invention. With particular reference to FIG. 2, the airfoil blade is formed from a pair of relatively thin shell members 12, 14 which themselves may be formed from galvanized steel sheets. Each of the sheets is initially flat, and the sheets are bent into the shapes shown by suitable roll forming techniques. As illustrated in FIG. 2, the shell members 12, 14 are substantially identical and are manufactured in the same manner. As also shown therein, the upper shell member 12 essentially mirrors the lower shell member 14, to which it is interconnected in the manner discussed hereinafter.

Each shell member 12, 14 includes an end seam 16 at one end thereof which is bent back upon the body of the respective shell member 12, 14 to provide a lock seam 18 which captures the free side edge 20 of the opposed shell member 12, 14. By capturing the free side edges 20, the two shell members 12, 14 are rigidly interlocked along both of their side edges 20. The edges of the blade 10 are parallel.

The airfoil blade 10 has a hollow airfoil shape best shown in FIG. 2. The shell members 12, 14 form the walls of the blade 10, and the shell members 12, 14 converge toward the interlocked edges to give the blade 10 a tapered profile. Center portions 22 of the respective upper and lower shell member 12, 14 are spaced apart from one another to provide the center portion of the blade 10 with a predetermined thickness. The blade 10 gradually tapers from the center portion toward each of the opposite edges.

Figure 3:
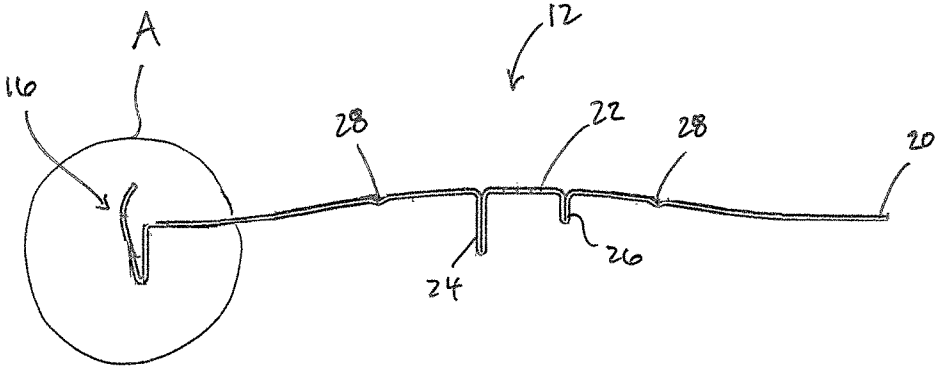
FIG. 3 is cross-sectional view of a shell member of the airfoil blade of FIG. 2.

Turning now to FIG. 3, a cross-sectional view of shell member 12 is illustrated. Shell member 14 is substantially identical to shell member 12 and is manufactured in a substantially identical manner, however only shell member 12 is being shown for clarity. As discussed above, shell member 12 may be formed from a sheet of galvanized steel in a roll forming operation.

The shell member 12 includes a first edge having a generally V-shaped end seam 16 and an opposed free edge 20. The shell member 12 is generally arcuate in shape and has a center portion 22. On opposing sides of the center portion 22, downwardly depending legs are formed by bending the sheet of material back upon itself. In particular, a first depending leg or seam 24 is formed between the end seam 16 and the center portion 22 and a second depending leg or seam 26 is formed between the center portion and the free edge 20. As shown, the height of the first depending leg 24 is greater than the height of the second depending leg 26. The shell member 12 also includes a pair of spaced apart strengthening ribs 28 formed in the body of the shell member 12 adjacent to the center portion 22 and outside the legs 24, 26, respectively. The ribs 28 are formed by corrugations in the shell member 12 and serve as stiffeners which enhance the strength of the airfoil blade 10. Each rib 28 has a V-shaped configuration and extends into the interior of the blade 10.

Figure 4:
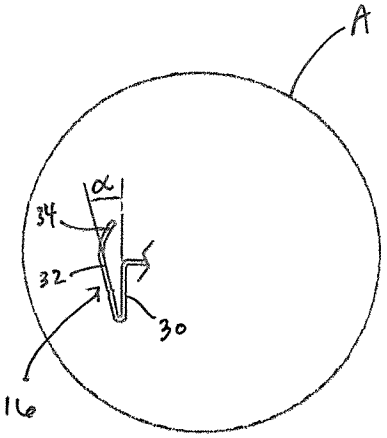
FIG. 4 is an enlarged, detail view of area A of FIG. 3.

As shown in FIGS. 3 and 4, the end seam 16 is generally V-shaped and has a first leg portion 30 that extends from the shell member body at a substantially ninety-degree angle, a second leg portion 32 that extends from the first leg portion 30 to form an angle, therebetween, and an arcuate tail portion 34 that extends from the second leg portion 32 over the open end of the end seam 16. In an embodiment, the angle, is between approximately 10 and 20 degrees and, more preferably, is approximately 15 degrees.

Figure 5:
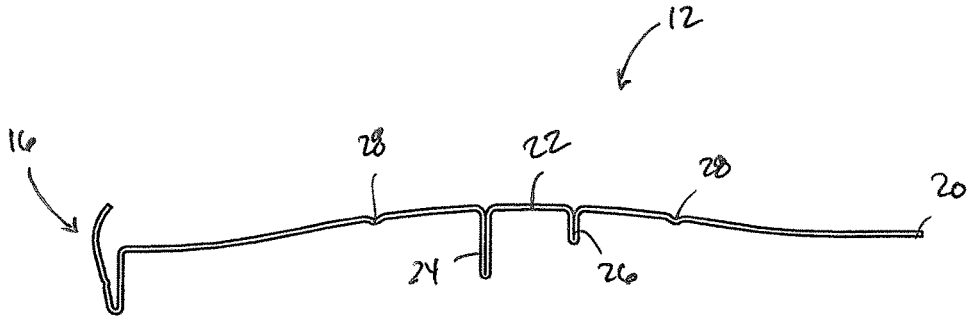
FIG. 5 is a cross-sectional view of the shell member of FIG. 3 after a roll forming operation.
Figure 6:
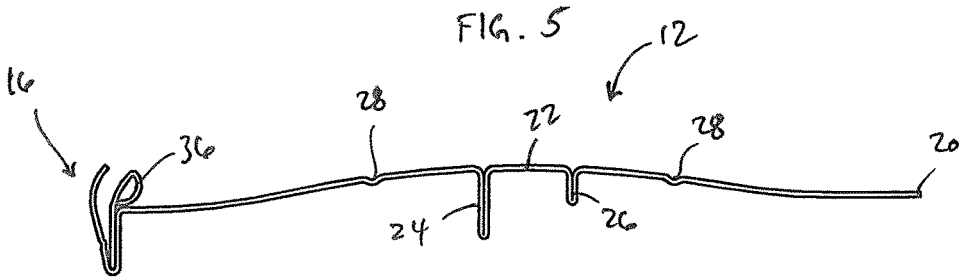
FIG. 6 is a cross-sectional view of the shell member of FIG. 3, illustrating the insertion of a silicone bead in an end seam of the shell member.
Figure 7:
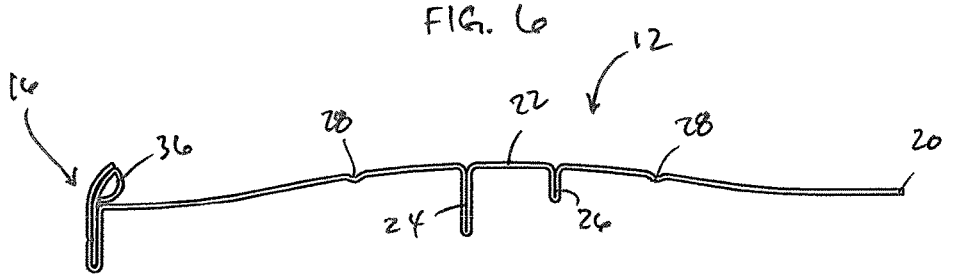
FIG. 7 is a cross-sectional view of the shell member of FIG. 3 after the end seam is closed.

With reference to FIGS. 5-10 assembly of the airfoil blade 10 utilizing shell members 12, 14 is illustrated. As best shown in FIG. 5, shell member 12, and the end seam 16, strengthening ribs 28, depending legs 24, 26 and center portion 22 thereof, are formed by repetitively bending, or roll forming, the sheet material on a single roll forming machine. Once the shell member 12 is suitably formed to the desired shape, a bead of sealant 36, such as silicone or vinyl, is then disposed along the length of the shell member 12 within the end seam 16. Importantly, the sealant 36 is deposited in the end seam 16 as part of an in-line manufacturing process on the same roll forming machine on which the shell member 12 is formed. The same roll forming machine is then utilized to close the end seam 16, as illustrated in FIG. 7.

Figure 8:
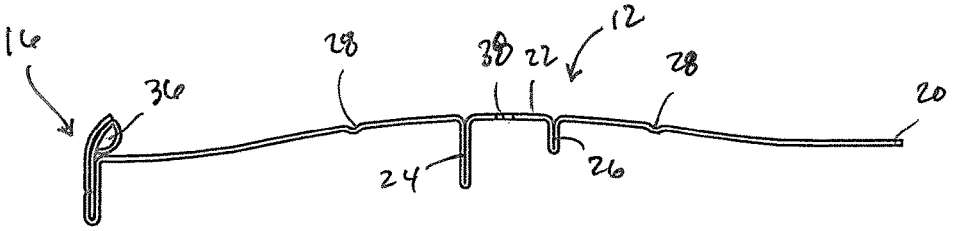
FIG. 8 is a cross-sectional view of the shell member of FIG. 3 after the shell member has been cut to length and locating apertures are punched in the shell member.

The shell member 12 is then cut to a desired length, and apertures 38 are pierced in shell member 12 in the center portion 22 at cutoff, as shown in FIG. 8. In an embodiment, the apertures 38 are located approximately 1.25 inches from the leading and trailing edges of each shell member 12 (i.e., from the left and right edges of a completed shell member). Importantly, the formation of the shell members 12, deposition of the sealant in the end seam 16, closing of the end seam 16, piercing of the apertures 38 and cutting the shell members 12 to the desired length is accomplished on a single machine without necessitating intervention or manipulation by an operator or technician. In an embodiment, the shell members 12, 14 are cut to a length of between approximately 8 inches and 60 inches, although the shell members 12, 14 may be cut to any length to form a blade assembly 10 having any desired span.

Figure 9:
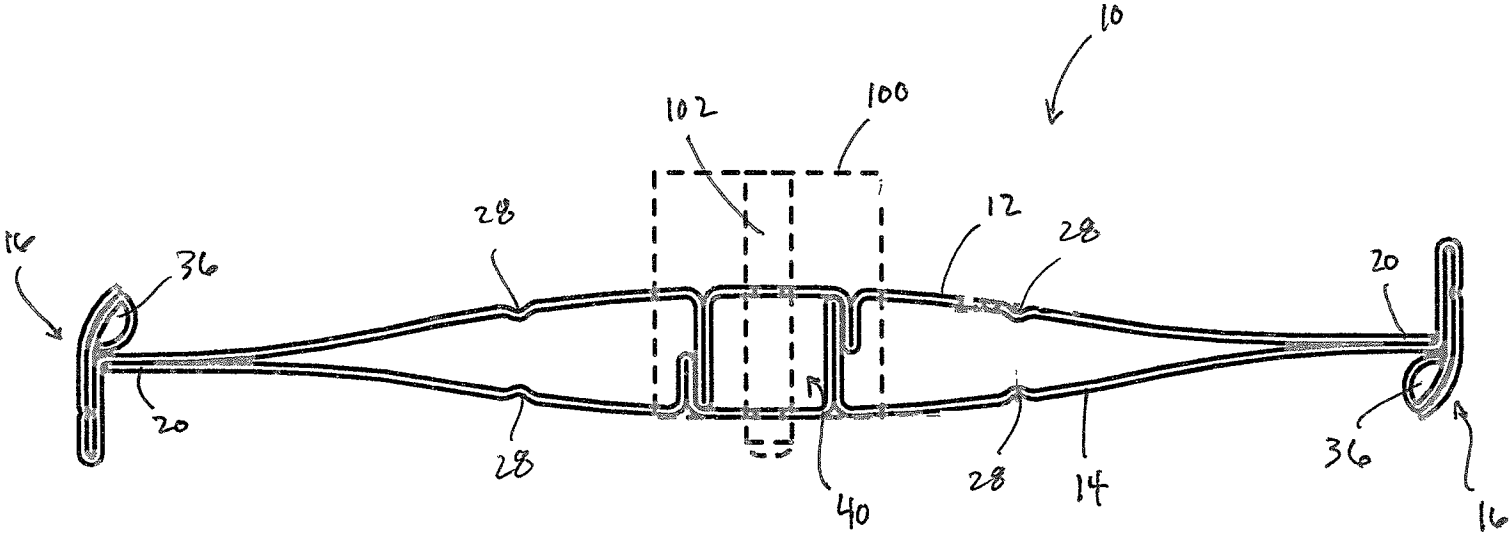
FIG. 9 is a cross-sectional view of the airfoil blade of FIG. 2, illustrating the joining of two shell members to one another.

Once multiple shell members 12 are produced, an operator will collect the shell members 12. One shell member is then flipped over on its backside (e.g., shell member 14 in FIG. 9). A mating shell member 12 is then placed directly on top of shell member 14, as shown in FIG. 9. A pin fixture 100 having pins 102 may then be placed on each end such that pins 102 extend through the apertures 38 in both shell members 12, 14 to properly locate and align the shell members, 12, 14 with one another. The airfoil blade 10 is then transferred to a bending/joining apparatus where the end seams 16 of each shell member 12, 14 are bent towards the center portion 22 (to close the ninety-degree bend between the shell member body and the first leg portion 30 of the end seam 16). This bending operation forms lock seams 18 which capture the free edges 20 of the opposed shell member 12, 14 therein.

This formation of the lock seams 18, and capturing the free edges 20 of the corresponding shell member 12, 14, respectively, therein, serves to lock the shell members 12, 14 to one another to form the completed airfoil blade assembly 10. The pin fixtures 100 may then be removed and reused in the assembly of another airfoil blade. The completed airfoil blade assembly 10 is illustrated in FIG. 2. As shown, the sealant beads 36 are located on opposed edges (front and back), and opposed sides (upper and lower) of the blade assembly 10. In an embodiment, the sealant beads 36 may be formed from silicone where the intended use for the damper blades 10 is in fire dampers. In other embodiments, the sealant bead may be formed from other materials, such as vinyl and the like, without departing from the broader aspects of the present invention.

Importantly, as best illustrated in FIG. 2, the opposed depending legs 24, 26 of each shell member 12, 14 define a longitudinal passageway or channel 40 for the passage of an axle, as hereinafter described. In particular, as shown in FIG. 2, the longer, first depending legs 24 extend from the shell member body from which they are formed substantially to the blade body of the opposed shell member. The shorter, second depending leg 26 of each shell member is configured to lie outside the first depending leg 24 of the opposing shell member, and functions to provide bolstering support for the first depending legs 24, as illustrated in FIG. 2 (i.e., the second legs 26 buttress the first legs 26). In this manner, the bolstering legs 26 help to maintain the structural rigidity of the first depending legs 24, thereby maintaining the integrity and square form of the channel 40 during operation. Moreover, the four standing seams (i.e., the first and second depending legs 24, 26 of each shell member 12, 14) provide strength to the completed blade assembly 10 and provide a pocket for the axle, as discussed hereinafter. Accordingly, there is no need to utilize a separate bracket to locate the axle, which eliminates many of the tedious steps required for existing methods of assembly.

Figure 1:
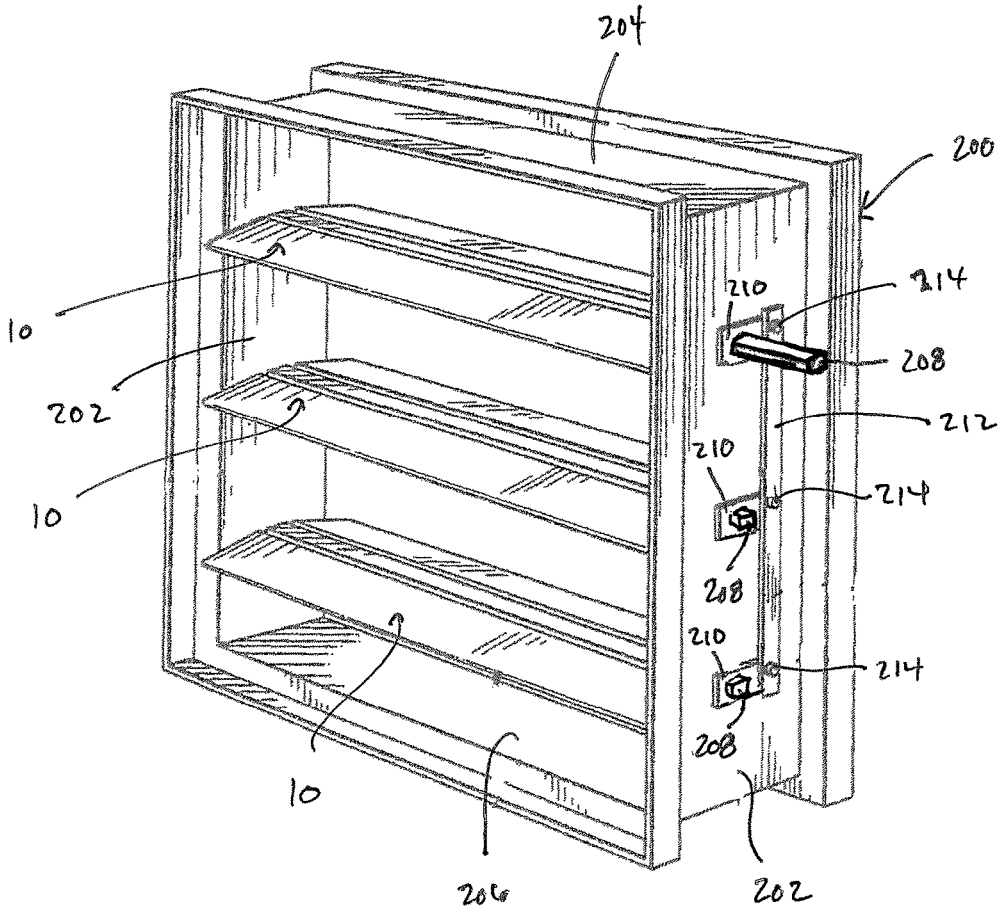
FIG. 1 is a schematic illustration of a flow control damper equipped with airfoil blades in a fully open position.

Referring to FIG. 1, once the airfoil blade assemblies 10 are constructed in the manner hereinbefore described, they may be dropped, one by one, into a rigid damper frame 200 having opposite sides 202, a top portion 204, and a bottom portion 206. The frame 200 is normally installed in a fluid flow passage, a portion of which is formed by a damper opening 216 presented within the frame 200 between the sides and the top and bottom of the frame.

The axle 208 for each blade may then be slid through the frame 200 and through the channel 40 within each blade assembly 10. In an embodiment, the axle may have a cross-section that is substantially similar to the square cross-section of the channel 40, at least along the longitudinal extent where the axle is received within the channel 40. In an embodiment, the axles 208 may be approximately ½" in thickness and have a square cross-section. The axles 208 are supported for pivotal movement on the opposite sides 202 of the frame 200. In particular, the axles 208 may be supported by round bushings that are themselves fixed in the frame 200. As will be readily appreciated, the axle channel 40 formed in the blade assembly 10 keeps the blades from twisting on the axles under torque.

Each axle 208 may be rigidly connected to a crank arm 210, and all of the crank arms 210 may be connected by a vertical linkage 212 pivoted at 214 to the crank arms 210. This arrangement pivots the blade assemblies 10 in unison between the fully opened positioned shown in FIG. 1 and the fully closed position in which the blades 10 are oriented vertically to close the damper opening. Other means of linking the axles 208 so that the blades 10 may be opened or closed in unison may also be utilized without departing from the broader aspects of the present invention. The damper blades 10 can be positioned anywhere between the fully opened and fully closed positions.

Due to the provision and configuration of the depending legs 24, 26, the need to utilize separate hardware to locate, secure and align each axle within each blade assembly 10 may be obviated. This eliminates costly and tedious manufacturing steps. The configuration of these legs 24, 26 also adds strength to the blade assembly 10 in comparison to existing blades. In addition, by roll forming the shell members and depositing the sealant bead 38 as part of an inline manufacturing process on a single machine, manufacturing efficiency and cost reductions may therefore be realized.

The enhanced stiffening of the center portion of the blade 10 provided by the legs 24, 26 and the ribs 28 eliminates the need to add separate reinforcement tubes or other reinforcement members. Because of the enhanced strength and resistance to deflection provided by the legs 24, 26 and ribs 28, the sheet members 12 and 14 can be relatively light gauge sheet metal so that both the cost and the weight of the damper are reduced without sacrificing strength or other desirable performance characteristics. For example, acceptable results can be obtained from the use of 20 gauge coil stock, although other sheet thicknesses may also be utilized.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. An airfoil blade assembly, comprising:

an upper shell member having an upper free distal end and an upper lock seam opposite the upper free distal end;

a lower shell member having a lower free distal end and a lower lock seam opposite the lower free distal end;

said upper shell member further comprising an upper end seam adjacent to said upper lock seam, and a first sealant bead disposed along a length of said upper shell member within said upper end seam;

said lower shell member further comprising a lower end seam adjacent to said lower lock seam, and a second sealant bead disposed along a length of said lower shell member within said lower end seam; and wherein said lower shell member is invertedly disposed and connected to said upper shell member;

wherein said upper shell member has a first central portion defined by a first long seam and a first short seam, and at least one upper corrugation rib between said first central portion and one end of said upper shell member; and said lower shell member has a second central portion defined between a second long seam and a second short seam, and at least one lower corrugation rib between said second central portion and one end of said lower shell member.

2. The airfoil blade assembly according to claim 1, wherein:

said upper free distal end is received in said lower lock seam; and said lower free distal end is received in said upper lock seam.

3. The airfoil blade assembly according to claim 1, wherein:

said first long depending seam is longer than said first short depending seam; and said second long depending seam is longer than said second short depending seam.

4. A damper assembly, comprising:

a frame;

an axle rotatably mounted to said frame; and an airfoil blade assembly operatively mounted to said axle;

wherein said airfoil blade assembly includes an upper shell member and a lower shell member;

wherein said upper shell member has a first central portion defined by a first long seam and a first short seam, and at least one upper corrugation rib between said first central portion and one end of said upper shell member; and said lower shell member has a second central portion defined between a second long seam and a second short seam, and at least one lower corrugation rib between said second central portion and one end of said lower shell member; and wherein said lower shell member is invertedly disposed and connected to said upper shell member.

5. The damper assembly according to claim 4, wherein:

said upper shell member includes a first lock seam at one end and a first free distal end at an opposite end of said upper shell member; and said lower shell member includes a second lock seam at one end and a second free distal end at an opposite end of said lower shell member.

6. The damper assembly according to claim 5, wherein:
said first free distal end of said upper shell member is received in said second lock seam of said lower shell member; and
said second free distal end of said lower member is received in said first lock seam of said upper shell member.

7. The damper assembly according to claim 4, wherein:
said upper shell member further includes a first end seam adjacent to said first lock seam; and
said lower shell member further includes a second end seam adjacent to said second lock seam.

8. The damper assembly according to claim 7, wherein:
a first sealant bead is disposed along a length of said upper shell member within said first end seam; and
a second sealant bead is disposed along a length of said lower shell member within said second end seam.

9. The damper assembly according to claim 8, wherein:
said first end seam and said second end seam are generally "V" shaped.

10. The damper assembly according to claim 4, wherein:
said first long depending seam is longer than said first short depending seam; and
said second long depending seam is longer than said second short depending seam.

11. The damper assembly according to claim 10, wherein:
said first short seam lies outside of said second long seam; and
said second short seam lies outside of said first long seam.

12. The damper assembly according to claim 4, wherein:
said damper assembly further includes:
a second axle rotatably mounted to said frame;
a second airfoil blade assembly operatively mounted to said second axle;
a first crank arm connected to said axle;
a second crank arm connected to said second axle; and
a vertical linkage member connected to said first crank arm and said second crank arm,
wherein said axle and said second axle are configured to pivot in unison.

13. A method for assembling an airfoil blade for a damper assembly, said method comprising the steps of:
forming an upper shell member to include an upper free distal end and an upper lock seam;
forming a lower shell member to include a lower free distal end and a lower lock seam;
forming an upper end seam in said upper shell member adjacent to said upper lock seam, and forming a lower end seam in said lower shell member adjacent to said lower lock seam,
disposing a first sealant bead along a length of said upper shell member within said upper end seam, and disposing a second sealant bead along a length of said lower shell member within said lower end seam; and
invertedly disposing said lower shell member with said upper shell member;
wherein said upper free distal end is received in said lower lock seam and said lower free distal end is received in said upper lock seam;
wherein said upper shell member has a first central portion defined by a first long seam and a first short seam, and at least one upper corrugation rib between said first central portion and one end of said upper shell member; and said lower shell member has a second central portion defined between a second long seam and a second short seam, and at least one lower corrugation rib between said second central portion and one end of said lower shell member.

14. The method according to claim 13, further comprising the steps of:
in said upper shell member, forming a first central portion, a first long depending seam on one end of said first central portion, and a first short depending seam on the other end of said first central portion, wherein said first long depending seam is longer than said first short depending seam; and
in said lower shell member, forming a second central portion, a second long depending seam on one end of said second central portion, and a second short depending seam on the other end of said second central portion, wherein said second long depending seam is longer than said second short depending seam.

15. The method according to claim 13, further comprising the steps of:
rotatably mounting an axle to a frame; and
operatively mounting said airfoil blade to said axle.

16. The method according to claim 15, further comprising the steps of:
rotatably mounting a second axle to said frame;
invertedly disposing another lower shell member with another upper shell member;
operatively interlocking said another upper shell member and said another lower shell member, to form a second airfoil blade; and
operatively mounting said second airfoil blade to said second axle.

17. The method according to claim 16, further comprising the steps of:
securing said axle to a first crank arm;
securing said second axle to a second crank arm; and
connecting a vertical linkage member to said first crank arm and said second crank arm;
wherein said airfoil blade and said second airfoil blade are configured to pivot in unison.

* * * * *